US009717320B1

(12) United States Patent
Williams

(10) Patent No.: US 9,717,320 B1
(45) Date of Patent: Aug. 1, 2017

(54) PROFESSIONAL HIGHLIGHT TESTING TOOL AND TOOL SET

(71) Applicant: Raymond Williams, Boca Raton, FL (US)

(72) Inventor: Raymond Williams, Boca Raton, FL (US)

( * ) Notice: Subject to any disclaimer, the term of this patent is extended or adjusted under 35 U.S.C. 154(b) by 0 days.

(21) Appl. No.: 15/283,073

(22) Filed: Sep. 30, 2016

(51) Int. Cl.
*G09B 19/10* (2006.01)
*A45D 44/00* (2006.01)
*A41G 5/00* (2006.01)

(52) U.S. Cl.
CPC ..... *A45D 44/005* (2013.01); *A41G 5/0073* (2013.01)

(58) Field of Classification Search
USPC ..... 434/94; 132/53, 200, 201, 212, 273; 206/581
See application file for complete search history.

(56) References Cited

U.S. PATENT DOCUMENTS 1,801,751 A * 4/1931 Mills ..... A45D 44/005 206/486
3,702,508 A * 11/1972 Netter ..... G09F 5/04 206/388
D276,661 S * 12/1984 Cafazzo ..... 434/99
5,609,484 A * 3/1997 Hawiuk ..... A45D 44/005 434/94
5,779,479 A * 7/1998 Hawiuk ..... G09B 19/0069 132/208
5,899,211 A * 5/1999 Brown ..... A45D 8/34 132/201
6,612,312 B2 * 9/2003 Silva ..... A45D 8/00 132/200
6,634,366 B1 * 10/2003 Simmons ..... A41G 5/0073 132/278
6,918,767 B2 * 7/2005 Ploix ..... A45D 44/005 434/94
8,434,500 B2 * 5/2013 Alex ..... A41G 5/008 132/201
8,590,543 B2 * 11/2013 Goff ..... A41G 5/008 132/212
8,813,761 B2 * 8/2014 Guliker ..... A41G 5/004 132/53
9,138,024 B1 * 9/2015 Solomon ..... A41G 5/0073
9,211,479 B2 * 12/2015 Miller ..... A63H 3/44
2004/0163660 A1 * 8/2004 Kellmann ..... A41G 5/0073 132/201

(Continued)

*Primary Examiner* — Kurt Fernstrom
(74) *Attorney, Agent, or Firm* — Oltman, Flynn & Kubler

(57) ABSTRACT

A professional highlight testing tool set includes a highlight testing tool having a hair engaging clip including a hair clip and several arm portions protruding from and connected to the hair clip to extend generally parallel to the surface of a customer's head; and the tool set further including several hair retaining structures to which streaks of try-on highlighted hair are removably attached, one of the hair retaining structures being secured to each of the arm portions, where the hair retaining structures are provided in sets in which the sets of hair retaining structures are fitted with different colors of try-on highlighted hair, so that a hair professional can perform a method of fitting the mounting assembly with sets of hair retaining structures with different try-on highlighted hair colors and shades to determine the optimum highlighting color choice.

14 Claims, 3 Drawing Sheets

(56) References Cited

U.S. PATENT DOCUMENTS

| | | | | |
|---|---|---|---|---|
| 2005/0268928 | A1* | 12/2005 | Lane | A41G 3/00 132/53 |
| 2007/0144552 | A1* | 6/2007 | Eaton | A41G 5/0073 132/277 |
| 2008/0178902 | A1* | 7/2008 | Moeszinger | A41G 5/0093 132/273 |
| 2008/0276949 | A1* | 11/2008 | Lee | A41G 5/0066 132/53 |
| 2011/0247643 | A1* | 10/2011 | Tokko | A41G 5/0066 132/201 |
| 2011/0253165 | A1* | 10/2011 | Kenna | A41G 5/0073 132/273 |
| 2012/0073592 | A1* | 3/2012 | Koenig | A41G 5/0046 132/201 |
| 2013/0032162 | A1* | 2/2013 | Major | G09B 19/00 132/54 |

* cited by examiner

PROFESSIONAL HIGHLIGHT TESTING TOOL AND TOOL SET

BACKGROUND OF THE INVENTION

1. Field of the Invention

The present invention relates generally to the field of tools for use by hair salon professionals. More specifically the present invention relates to a highlight testing tool, tool set and method for use by the professional hair stylist to intersperse into the hair of a salon customer a series of streaks of removable try-on highlight hair of different colors and tones so that the customer can select which one she considers to be the optimum highlight color and tone for her hair, and so that the hair stylist can subsequently proceed with applying the selected highlight to the customer's own hair.

The present tool set includes the testing tool which preferably takes the form of a hair clip having a clip frame for engaging strands of hair at the crown of the customer's head to anchor the tool to the crown of the head and further includes preferably two substantially parallel and spaced apart first and second arm portions protruding from the clip frame for directing forwardly on the customer's head. The tool set further includes at least two and preferably sixteen sets of first and second hair retaining structures since the industry provides streaks of sixteen different colors and tones. Each hair retaining structure preferably is a hair retaining tube sized to fit snugly and removably over either of the arm portions, to which spaced apart groups of try-on highlighted hair strands are connected. The arm portions extend forwardly, so that the streaks of try-on highlighted hair drape generally downward from the crown of the customer's head along customer's own hair, where they are interspersed temporarily for testing.

Therefore throughout this application the invention as a whole is referred to as the tool set, which includes a tool made up of a hair clip and preferably first and second arm portions protruding from the hair clip. The hair retaining structures can be any elongate structures to which are secured spaced apart groups of laterally extending strands of try-on highlighted hair, once again referred to herein as streaks. As noted, the hair retaining structures preferably each take the form of a tube to which the streaks are attached and which removably slides over one of the arm portions. This specific type of hair retaining structure is referred to herein as a hair retaining tube. Several sets of hair retaining tubes having streaks of different colors and tones are provided so that they can be mounted on the tool one after another so that the customer can see which color or tone is the best match for the hair of the particular customer.

The hair clip preferably includes adjacent upper and lower clip structures between which the customer's own strands of hair are engaged. The upper clip structure preferably includes forward and rearward clip cross members and first and second arm portions joined at their ends to define a generally rectangular clip frame. The first and second arm portions respectively preferably extend across opposing ends of and are fastened to the forward and rearward clip cross members. The lower clip structure preferably is connected to and protrudes forwardly from the rearward clip cross member and extends across and below the forward clip cross member so that the lower clip structure passes close to or vertically abuts the forward clip cross member. As a result, strands of the customer's own hair can be pushed and thereby compressed between upper and lower clip structures to engage the customer's own hair and hold the tool in place on the customer's head. The lower clip structure preferably is configured as a strip following a high amplitude sign wave, rather than as a solid panel, to be more flexible and to better engage strands of customer hair.

The arm portions preferably are ductile to permit them to be manually bent to follow the slight curvature of the individual customer's head prior to being fitted with the hair retaining tubes. The hair retaining tubes preferably are flexible along their lengths to fit onto the curved arm portions. More specifically, the arm portions preferably are flat, elongate strips of a ductile metal such as aluminum. The hair clip preferably is formed of light-weight spring steel, and preferably is covered or coated with shrink-wrap to be smooth and soft to the touch.

2. Description of the Prior Art

Professional highlighting of hair is a service long provided by hair salons. A problem has been in selecting a highlighting color or shade which is a good match to hair of a particular customer. Selecting the right highlighting has been largely a matter of chance, and as a result what is needed is a way for a customer to reliably test and select a highlight color or tone before it is applied to the customer's hair.

It is thus an object of the present invention to provide a professional tool and tool set for the styling professional that intersperses tool set try-on highlighted hair strands with existing salon customer's own hair to simulate highlighting of the customer's own hair and which is removable, so that the customer and her styling professional can make a visual pre-evaluation to determine in advance whether the highlighting is a good aesthetic match for the customer's own hair, and to a method of using the tool set.

It is another object of the present invention to provide such a professional tool and tool set which include a hair clip and several hair retaining structures to be removably fitted to the hair clip and to which a variety of different colors and shades of try-on highlighted hair are attached.

It is a still further object of the present invention to provide such a professional tool which can be manually adjusted such as through bending to fit and conform to the size and shape of an individual customer's head.

It is yet another object of the present invention to provide such a professional tool and tool set which is simple in construction so that its operation is quickly understood by a beautician or other hair professional working in a salon and it is easy for such a professional to fit the highlight testing tool to a customer's head in minimal time.

It is finally an object of the present invention to provide such a highlight testing tool which is highly inexpensive to manufacture, sturdy and reliable.

SUMMARY OF THE INVENTION

The present invention accomplishes the above-stated objectives, as well as others, as may be determined by a fair reading and interpretation of the entire specification.

A professional highlight testing tool set, including a highlight testing tool having a hair clip with a hair engaging mechanism and at least one and preferably a number of arm portions protruding from and connected to the hair engaging mechanism to extend generally parallel to the surface of a user head, and a number of hair retaining structures to which streaks of try-on highlighted hair are removably attached, one of the hair retaining structures being secured to each of the arm portions; so that try-on highlighted hair extending from the hair retaining structures drapes over and can be manually interspersed with user hair to determine whether the given try-on highlighted hair color is an aesthetically pleasing match for the user hair color, where the hair retaining structures and are provided in sets in which the sets of hair retaining structures are fitted with different colors of try-on highlighted hair, and so that a hair professional can fit the mounting assembly with sets of hair retaining structures with different try-on highlighted hair colors and shades to determine the optimum highlighting color choice.

The hair engaging mechanism preferably includes an upper clip structure and a lower clip structure for engaging between them the strands of user hair. The upper clip structure preferably includes a forward clip cross member and a rearward clip cross member and a first arm portion and a second arm portion joined at their ends to define a generally rectangular clip frame from which the arm portions protrude forwardly. The lower clip structure preferably is connected to and protrudes forwardly from the rearward clip cross member and extends across and below the forward clip cross member so that the lower clip structure passes close to or vertically abuts the forward clip cross member, so that strands of the user hair can be pushed and thereby compressed between the upper and lower clip structures to engage the user hair and hold the tool in place on the user head. The lower clip structure optionally is configured as a strip following a high amplitude sign wave for enhanced flexibility and hair engagement.

Each hair retaining structure preferably includes a flat, elongate strip of ductile material defining an arm portion secured to and extending from the hair engaging mechanism, which is bendable by hand to conform to the shape of the individual user head. The arm portions preferably are generally parallel to each other, and positioned to extend along the upper portion of a user head, so that try-on highlighted hair can extend generally downward from the crown of a user head.

Each hair retaining structure preferably includes a hair retaining tube sized to fit snugly over one arm portion to which try-on highlighted hair is connected. Each hair retaining tube preferably is fitted with a spaced apart longitudinal series of streaks of try-on highlighted hair. Each hair retaining tube preferably includes a longitudinal series of tube openings along one side of the given hair retaining tube, and strands of try-on highlighted hair in the form of a streak is wrapped around each hair retaining tube.

A method of using the professional highlight testing tool set, including the steps of: providing the tool set; selecting a set of hair retaining structures having try-on highlighted hair of a desired color and tone for testing on the user hair; securing the selected hair retaining structures to the arm portions of hair engaging clip; fitting the hair engaging clip to the user head so that the arm portions extend along the surface of the hair on the user head and the try-on highlighted hair drapes over the user hair; evaluating the aesthetic color and tone contrast between the try-on highlighted hair and the user hair; and removing the tool from the user head.

The method preferably includes the additional step of interspersing the try-on highlighted hair with the user hair. The method preferably includes the yet additional steps of: selecting a second set of hair retaining structures having different try-on highlighted hair; replacing the first set of hair retaining structures by removing the first set of hair retaining structures on the arm portions with the second set of hair retaining structures; fitting the hair engaging clip to the user head so that the arm portions extend along the surface of the hair on the user head and the try-on highlighted hair drapes over the user hair; evaluating the aesthetic color and tone contrast between the try-on highlighted hair and the user hair; and removing the tool from the user head. Finally, the method preferably includes the yet additional step of interspersing the try-on highlighted hair with the user hair.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
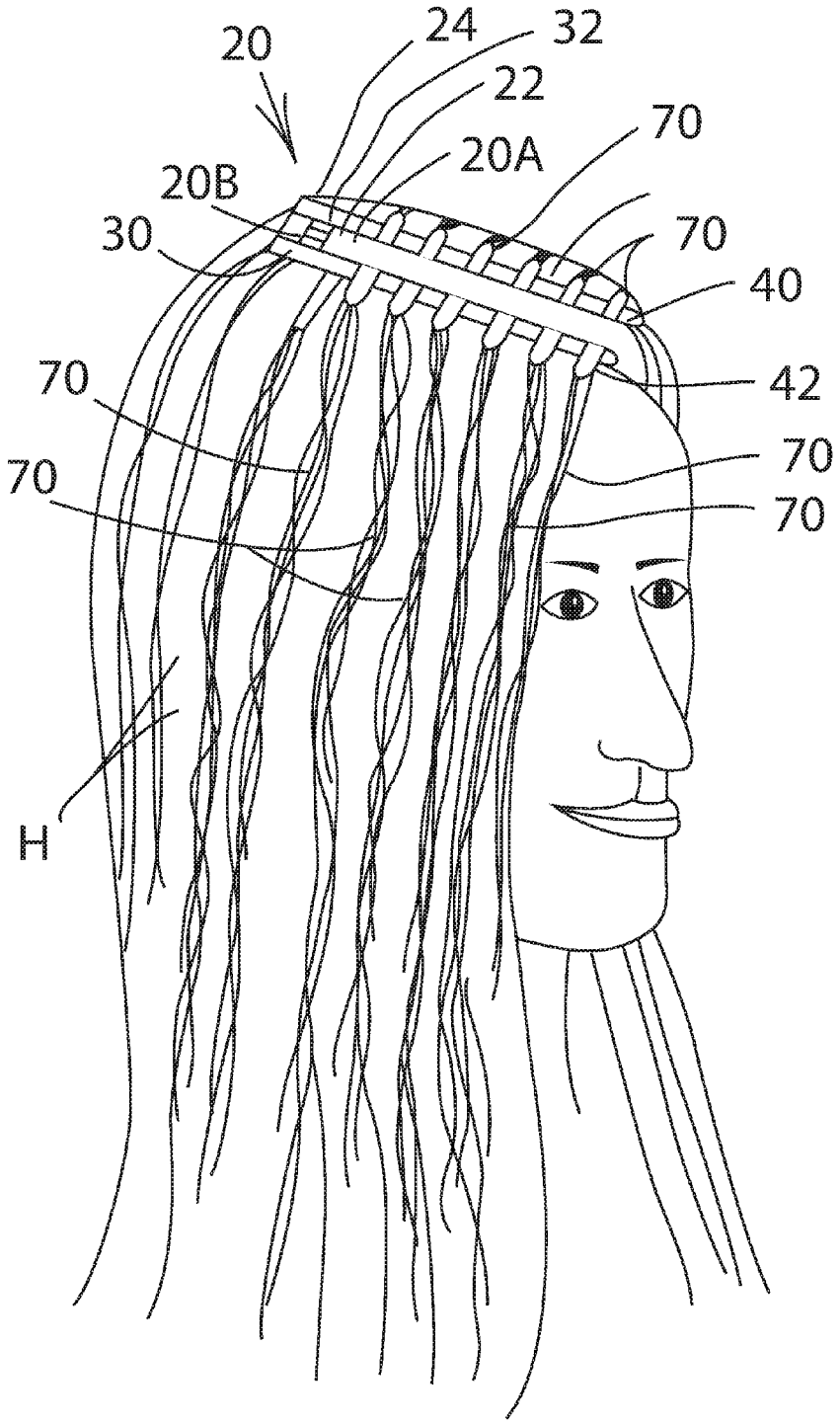
FIG. 1 is a perspective view of the first preferred embodiment of the highlight testing tool secured to the hair at the crown of the head of a customer, with streaks extending downwardly from the tool and over the natural hair of the customer.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
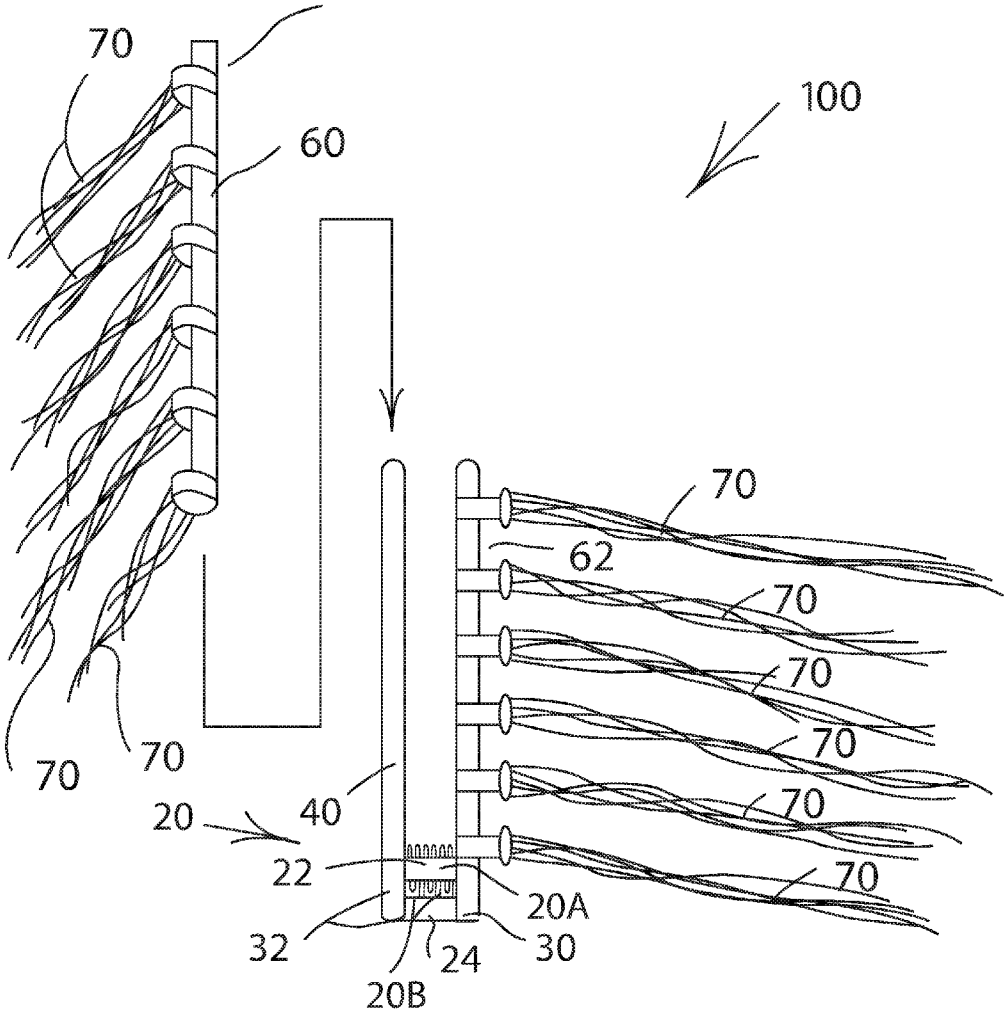
FIG. 2 is top plan view of the tool set showing the testing tool and a hair retaining structure fitted onto one arm portion of the tool and another hair retaining stnicture ready to fit onto the other arm portion.
Figure 3:
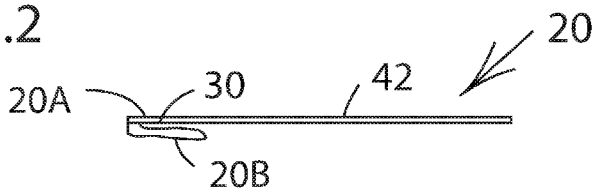
FIG. 3 is a side, edge view of the hair clip.
Figure 4:
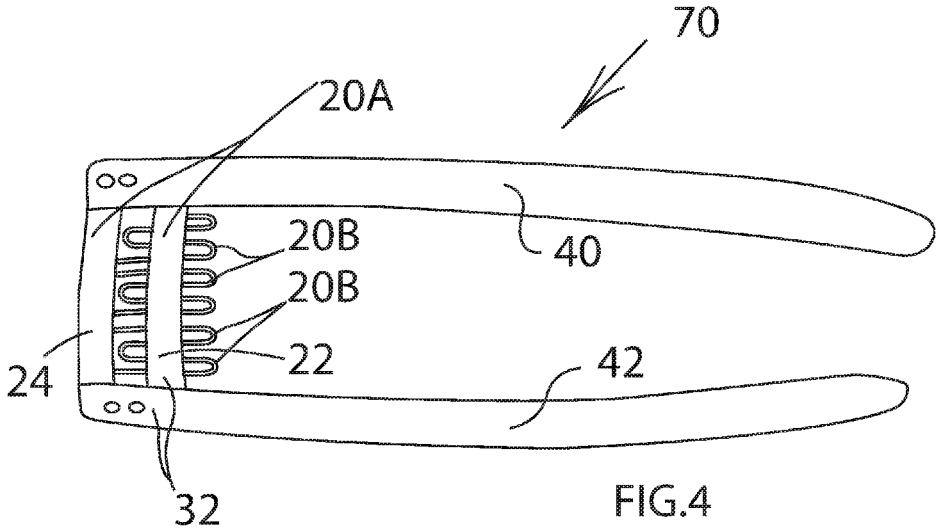
FIG. 4 is a close-up top view of the preferred hair clip.
Figure 5:
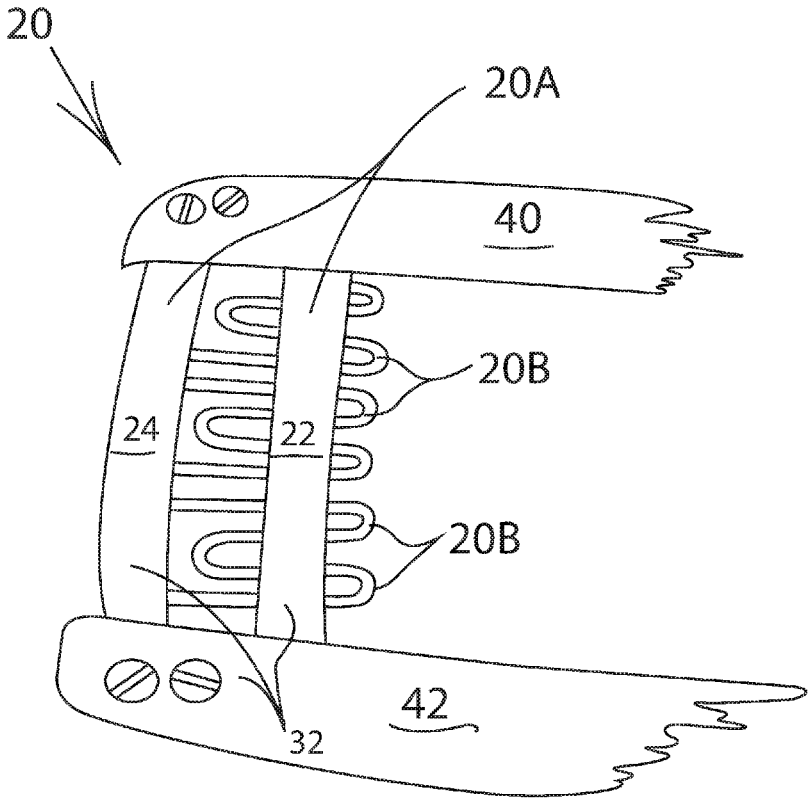
FIG. 5 is an enlarged, broken away top view of the frame portion of the preferred hair clip.

Referring to FIGS. 1-5, a professional highlight testing tool set 100 including a highlight testing tool 10 is disclosed, the testing tool 10 including a hair clip 30 for engaging strands of hair H to anchor the tool 10 to the crown of a customer's head, and further includes substantially parallel and spaced apart first and second arm portions 40 and 40A protruding from the hair clip 30 for directing forwardly on the customer's head. The tool set 100 further includes at least two and preferably sixteen sets of first and second hair retaining structures 60 and 60A, since there preferably are streaks 70 of sixteen different colors and tones. Each hair retaining structure 60 and 60A preferably takes the form of a hair retaining tube sized to fit snugly and removably over either of the arm portions 40 and 40A, to which spaced apart try-on highlighted hair streaks 70 are connected. The arm portions 40 and 40A extend forwardly so that the streaks 70 drape generally downward from the crown of the customer's head along the customer's own hair, where they are interspersed temporarily for testing.

The hair clip 20 preferably includes a hair engaging mechanism 30 including adjacent upper and lower clip structures 20 and 20A between which the customer's own strands of hair H are engaged. The upper clip structure 20 preferably includes forward and rearward clip cross members 22 and 24 and first and second arm portions 40 and 42 joined at their ends to define a generally rectangular clip frame 32. The first and second arm portions 40 and 42 respectively preferably extend across opposing ends of and are fastened to the forward and rearward clip cross members 22 and 24. The lower clip structure 20A preferably is connected to and protrudes forwardly from the rearward clip cross member 22 and extends across and below the forward clip cross member 22 so that the lower clip structure 20A passes close to or vertically abuts the forward clip cross member 22. As a result, strands of the customer's own hair H can be pushed and thereby compressed between upper and lower clip structures 20 and 20A to engage the customer's own hair and hold the tool 10 in place on the customer's head. The lower clip structure 20A preferably is configured as a strip following a high amplitude sign wave, rather than as a solid panel, to be more flexible and to better engage strands of customer hair H.

The arm portions 40 and 42 preferably are ductile to permit them to be manually bent to follow the slight curvature of the individual customer's head prior to being fitted with the hair retaining tubes 60 and 62. The hair retaining tubes 60 and 62 preferably are flexible along their lengths to fit onto the curved arm portions 40 and 42. The arm portions 40 and 42 preferably are flat, elongate strips of ductile metal such as aluminum. The hair clip preferably is formed of light-weight spring steel and preferably is covered or coated with shrink-wrap to be smooth and soft to the touch.

As noted, several sets S of these hair retaining structures 60 together with the tool 10 preferably are provided as tool set 100, hair retaining structures 60 having hair streaks 70 of different highlight colors and shades so that several sets S can be tried on a person sequentially until the most suitable highlight color or shade is found, prior to a professional hairstylist performing actual highlighting on the hair H of their client. Hair streaks 70 are provided in both wide and narrow versions. Thus tool 10 is a professional tool rather than a consumer end product.

The arm portions 40 preferably extend generally parallel to each other, and forwardly along the upper portion of the customer's head, so that try-on highlighted hair drapes generally laterally downward from the crown of the customer's head along customer's own hair H. Each hair retaining structure 60 preferably is a hair retaining tube 60, sized to fit snugly over any of the arm portions 40, to which try-on highlighted hair streaks 70 are connected.

Each hair retaining tube 60 and 60A preferably is fitted with a spaced apart longitudinal series of streaks of try-on highlighted hair 70 to position these streaks of hair 70 in a way similar to actual highlighting placement in the hair H of a customer. These streaks 70 preferably are substantially 0.25 inches wide and spaced 0.5 inches apart, with a preferred total of six streaks 70 on each hair retaining tube 60 and 60A. To retain these streaks of try-on highlighted hair 70 and to enhance flexibility, each hair retaining tubes 60 and 62 preferably each have a longitudinal series of tube openings or tube notches 64 cut away from one side of the hair retaining tube 60 or 62, so that a series of tube segments 66 remain between notches 64.

A streak of try-on highlighted hair streak 70 preferably is looped through each tube segment 66 parallel to the retaining tube 60 or 62 longitudinal axis A and tied on the outward face of the tube segment 66. Either one end or two ends of the streak of try-on highlighted hair 70 hang freely and drape over the customer's own hair H. This method of connecting a streak of try-on highlighted hair streak 70 is preferred because it presents minimal resistance to an arm portion 40 being inserted into and out of the tube segments 66, since the direction of movement of the arm portion 40 or 42 is parallel to the direction of the segment of try-on highlighted hair streak 70 within the tube segment 66.

Alternatively a streak of the hair streak 70 is wrapped across each of the tube notches 64 and around the tube 60 or 62 and tied in place or secured with a binding ring 72 around the streak adjacent the tube 60 or 62, and pushed into the tube notch 64 so that an arm portion 40 or 42 can slide across the streak of try-on highlighted hair streak 70, pressing the hair streak 70 against the interior surface of the tube 60 or 62 opposite the tube notch 64 to help anchor the given streak of try-on highlighted hair streak 70. Each hair retaining tube 60 or 62 preferably is formed of resilient plastic to further enhance its flexibility to fit over curved arm portions 40 and 42.

Method

In practicing the invention, the following method may be used. The method steps include providing the highlight testing tool set 100 including a highlight testing tool 10; selecting a set of hair retaining structures 60 and 62 having try-on highlighted hair 70 of a desired color and tone for testing on the customer's own hair H; securing the selected hair retaining structures 60 and 62 to the arm portions 40 and 42 of hair engaging clip 20; fitting the hair clip to the customer's head so that the arm portions 40 and 42 extend along the surface of the hair on the customer's head and the try-on highlighted hair streak 70 drapes over the customer's own hair H; interspersing the try-on highlighted hair streak 70 with the customer's own hair; evaluating the aesthetic color and tone contrast between the try-on highlighted hair and the customer's own hair; and removing the tool 10 from the customer's head. Additional steps can include selecting a second set of hair retaining structures 60 and 62 having different try-on highlighted hair streak 70; replacing the first set of hair retaining structures 60 and 62 by removing the first set of hair retaining structures 60 and 62 on the arm portions 40 and 42 with the second set of hair retaining structures 60 and 62; fitting the mounting structure to the customer's head so that the arm portions 40 and 42 extend along the surface of the hair on the customer's head and the try-on highlighted hair streaks 70 drape over the customer's own hair; interspersing the try-on highlighted hair streaks 70 with the customer's own hair, evaluating the aesthetic color and tone contrast between the try-on highlighted hair and the customer's own hair, and removing the tool 10 from the customer's head.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A professional highlight testing tool set, comprising:

a highlight testing tool comprising a hair clip with a hair engaging mechanism and a plurality of arm portions protruding from and connected to said hair engaging mechanism to extend generally parallel to the surface of a user head, and a plurality of hair retaining structures to which streaks of try-on highlighted hair are removably attached, one of said hair retaining structures being secured to each of said arm portions;

such that try-on highlighted hair extending from said hair retaining structures drapes over and can be manually interspersed with user hair to determine whether the given try-on highlighted hair color is an aesthetically pleasing match for the user hair color, wherein said hair retaining structures are provided in sets in which the sets of hair retaining structures are fitted with different colors of try-on highlighted hair, and such that a hair professional can fit said mounting assembly with sets of hair retaining structures with different try-on highlighted hair colors and shades to determine the optimum highlighting color choice.

2. The tool set of claim 1, wherein said hair clip comprises an upper clip structure and a lower clip structure for engaging between them the strands of user hair.

3. The tool set of claim 2, wherein said upper clip structure comprises a forward clip cross member and a rearward clip cross member and a first arm portion and a second arm portion joined at their ends to define a generally rectangular clip frame from which said arm portions protrude forwardly.

4. The tool set of claim 2, wherein said lower clip structure is connected to and protrudes forwardly from said rearward clip cross member and extends across and below said forward clip cross member such that said lower clip structure passes close to or vertically abuts said forward clip cross member;

such that strands of the user hair can be pushed and thereby compressed between said upper and lower clip structures to engage the user hair and hold said tool in place on the user head.

5. The tool set of claim 4, wherein said lower clip structure is configured as a strip following a high amplitude sine wave for enhanced flexibility and hair engagement.

6. The tool set of claim 1, wherein each said hair retaining structure comprises a flat, elongate strip of ductile material defining an arm portion secured to and extending from said hair engaging mechanism, which is bendable by hand to conform to the shape of the individual user head.

7. The tool set of claim 6, wherein said arm portions are generally parallel to each other, and positioned to extend along the upper portion of a user head, such that try-on highlighted hair can extend generally downward from the crown of a user head.

8. The tool set of claim 6, wherein each said hair retaining structure comprises a hair retaining tube sized to fit snugly over one said arm portion to which try-on highlighted hair is connected.

9. The tool set of claim 8, wherein each said hair retaining tube is fitted with a spaced apart longitudinal series of streaks of try-on highlighted hair.

10. The tool set of claim 9, wherein each said hair retaining tube comprises a longitudinal series of tube openings along one side of the given said hair retaining tube, and strands of try-on highlighted hair in the form of a streak is wrapped around each said hair retaining tube.

11. A method of using a professional highlight testing tool set comprising a highlight testing tool comprising a hair clip with a hair engaging mechanism and a plurality of arm portions protruding from and connected to said hair engaging mechanism to extend generally parallel to the surface of a user head, and a plurality of hair retaining structures to which streaks of try-on highlighted hair are removably attached, one of said hair retaining structures being secured to each of said arm portions, such that try-on highlighted hair extending from said hair retaining structures drapes over and can be manually interspersed with user hair to determine whether the given try-on highlighted hair color is an aesthetically pleasing match for the user hair color, wherein said hair retaining structures and are provided in sets in which the sets of hair retaining structures are fitted with different colors of try-on highlighted hair, and such that a hair professional can fit said mounting assembly with sets of hair retaining structures with different try-on highlighted hair colors and shades to determine the optimum highlighting color choice, comprising the steps of:

providing the tool set;

selecting a set of hair retaining structures having try-on highlighted hair of a desired color and tone for testing on the user hair;

securing the selected hair retaining structures to the arm portions of hair engaging clip;

fitting the hair engaging clip to the user head so that the arm portions extend along the surface of the hair on the user head and the try-on highlighted hair drapes over the user hair;

evaluating the aesthetic color and tone contrast between the try-on highlighted hair and the user hair;

and removing the tool from the user head.

12. The method of claim 11, comprising the additional step of interspersing the try-on highlighted hair with the user hair.

13. The method of claim 11, comprising the additional steps of:

selecting a second set of hair retaining structures having different try-on highlighted hair;

replacing the first set of hair retaining structures by removing the first set of hair retaining structures on the arm portions with the second set of hair retaining structures;

fitting the hair engaging clip to the user head so that the arm portions extend along the surface of the hair on the user head and the try-on highlighted hair drapes over the user hair;

evaluating the aesthetic color and tone contrast between the try-on highlighted hair and the user hair;

and removing the tool from the user head.

14. The method of claim 12, comprising the additional step of interspersing the try-on highlighted hair with the user hair.

* * * * *